United States Patent [19]

Evans

[11] 3,931,749

[45] Jan. 13, 1976

[54] REVERSIBLE SELF-RETAINING RATCHETING WRENCH

[76] Inventor: James P. Evans, 3233 SW. 23 St., Oklahoma City, Okla. 73108

[22] Filed: Nov. 5, 1974

[21] Appl. No.: 521,088

Related U.S. Application Data

[62] Division of Ser. No. 351,254, April 16, 1973, abandoned.

[52] U.S. Cl. ..... 81/119; 81/186

[51] Int. Cl. ..... B25b 13/08

[58] Field of Search ..... 81/119, 121 B, 121 R, 186

[56] References Cited

UNITED STATES PATENTS

| | | | |
|---|---|---|---|
| 1,072,479 | 9/1913 | Martindale | 81/121 B |
| 1,276,071 | 8/1918 | Ringling | 81/119 |
| 1,378,160 | 5/1921 | Woodville | 81/121 B |
| 2,716,367 | 8/1955 | Montgomery | 81/121 R |

FOREIGN PATENTS OR APPLICATIONS

| | | | |
|---|---|---|---|
| 22,578 | 11/1893 | United Kingdom | 81/119 |

*Primary Examiner*—Al Lawrence Smith
*Assistant Examiner*—James G. Smith
*Attorney, Agent, or Firm*—Head and Johnson

[57] ABSTRACT

A ratcheting wrench for a hexagonal member, the wrench having a body portion with a first and second jaws extending therefrom, the jaws being spaced apart from each other and providing a member receiving area therebetween, and a handle extending from the body, the first jaw having an inner peripheral surface facing the member receiving area having four contiguous torqueing surfaces configured to receive a hexagonal member, each of these torqueing surfaces being at an angle of 120° relative to any adjacent torqueing surface, and the second jaw having an inner peripheral surface facing the member receiving area having four contiguous torqueing surfaces configured to receive a hexagonal member, each of the torqueing surfaces being at an angle of 120° relative to any adjacent torqueing surface, the first jaw torqueing surfaces and the second jaw torqueing surfaces each being adaptable to separately contact four peripheral surfaces of a hexagonal member.

7 Claims, 14 Drawing Figures

REVERSIBLE SELF-RETAINING RATCHETING WRENCH

This is a division of application Ser. No. 351,254, filed Apr. 16, 1973, now abandoned.

BACKGROUND, SUMMARY AND OBJECTS OF THE INVENTION

Submitted to the U.S. Patent Office concurrently herewith is an application entitled "Self-Retaining Ratcheting Wrench" Ser. No. 351,253, filed Apr. 16, 1973, now Pat. No. 3,875,828. The present invention is an extension of and further application of the principles set forth in the above-identified copending application and includes concepts, arrangements, usages and configurations not disclosed in the above-identified copending application. In the copending application there is provided a wrench for engaging hexagonal members. The present invention is directed towards the concept of a wrench having at one end of a handle means for engaging a hexagonal member in a relationship wherein the hexagonal member may be rotated in either direction and in which the wrench ratchets upon the hexagonal member.

It is therefore an object of this invention to provide an improved wrench for rotating hexagonal members.

More particularly, an object of this invention is to provide an improved wrench for hexagonal members, including means for the ratchet rotation of a hexagonal member in either direction without the necessity of turning the wrench over or otherwise disengaging it from the hexagonal member being rotated.

Another object of this invention is to provide a wrench for the ratchet rotation of hexagonal members in which the wrench may be employed to rotate, at the same end thereof, and without adjustable components, two hexagonal members of different dimensions.

Another object of this invention is to provide a wrench for the ratchet rotation of two different size hexagonal members in either direction by the use of the wrench without turning the wrench over and without disengaging the wrench from the hexagonal member being rotated.

Another object of this invention is to provide a wrench for the ratchet rotation of hexagonal members including means for the ratcheting rotation of four different size hexagonal members.

Another object of this invention is to provide a ratcheting wrench for hexagonal members including improved means for increasing the wear resistance of the wrench.

Another object of this invention is to provide an open end wrench in which the wrench may be utilized for ratcheting eight different sized hexagonal members, the wrench having no moving parts.

Another object of this invention is to provide a ratcheting wrench of the box end type including means wherein a hexagonal member may be ratcheted in either direction without removing engagement of the box end wrench from the member being rotated.

These general objects, as well as other and more specific objects of the invention will be fulfilled in the following description and claims, taken in conjunction with the attached drawings.

DESCRIPTION OF THE VIEWS

Figure 5:
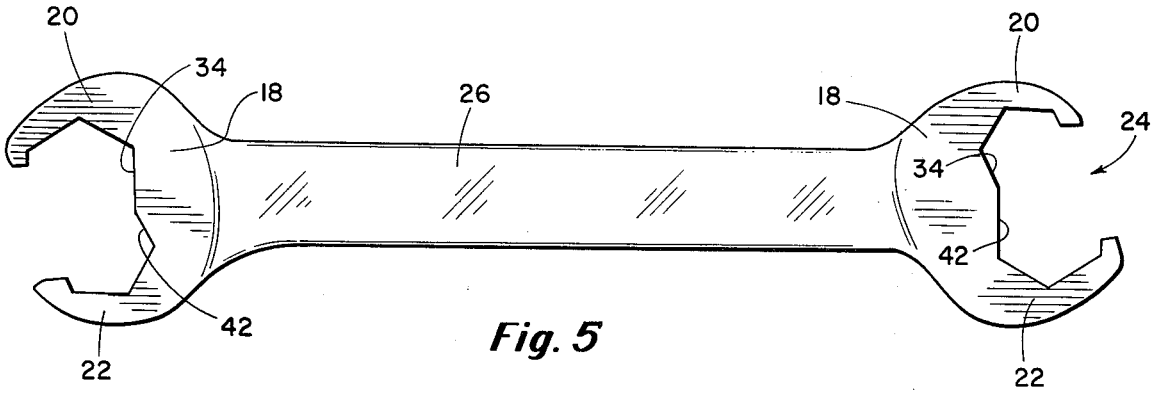
Figure 1:
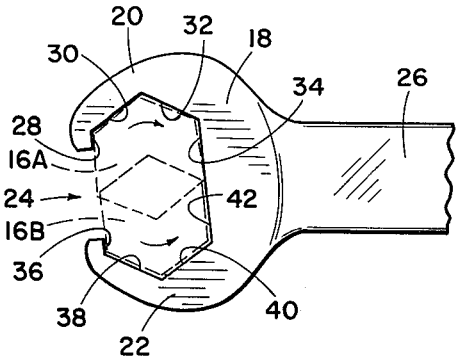
FIG. 1 is a plan view of a wrench embodying the invention, the wrench being usable for use in the ratchet rotation of a hexagonal member in either direction without removing the wrench from the hexagonal member being rotated.

FIG. 5 is a plan view of a wrench embodying this invention. The wrench is shown with a handle having a wrench configuration at each end, each of the configurations employing the invention. In the embodiment of FIG. 1 each end of the wrench is dimensioned to ratchet rotate two different sizes of hexagonal members.

Figure 6:
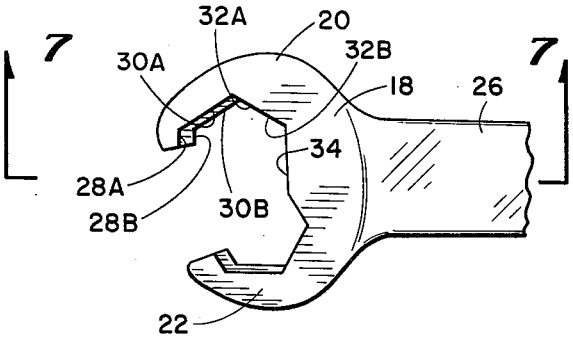

FIG. 6 is a plan view of an alternate arrangement of the invention wherein the hexagonal member engaging surfaces are divided into two levels, that is, an upper level and a lower level, and wherein the wrench may be utilized to ratchet rotate four different sizes of hexagonal members.

Figure 7:
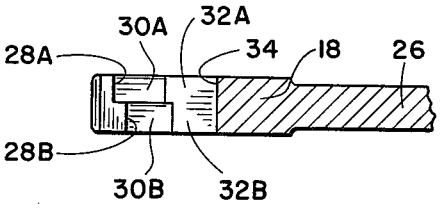

FIG. 7 is a cross sectional view taken along the line 7—7 of FIG. 6.

Figure 8:
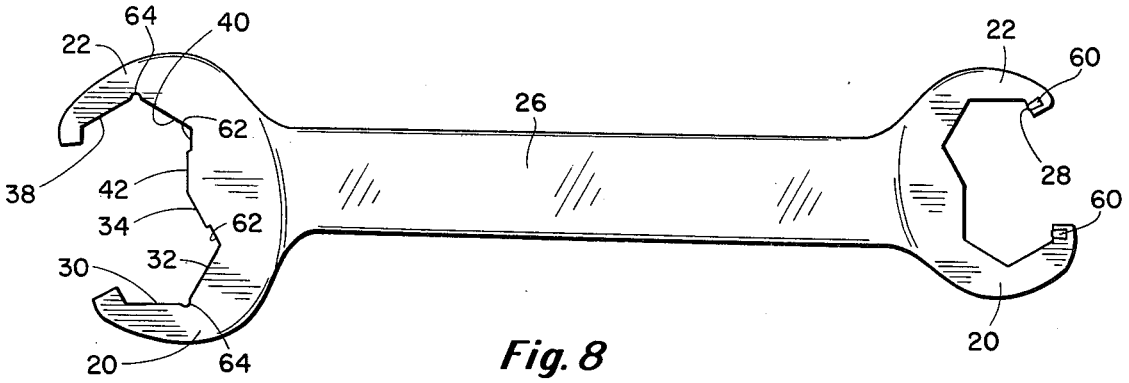

FIG. 8 is an alternate arrangement in which in the left hand portion of the wrench hard material inserts are employed to increase the wear resistance of the wrench. The right hand portion of the wrench shows an improved configuration by which the hexagonal member to be ratchet rotated is more easily received by the torqueing surfaces.

Figure 9:
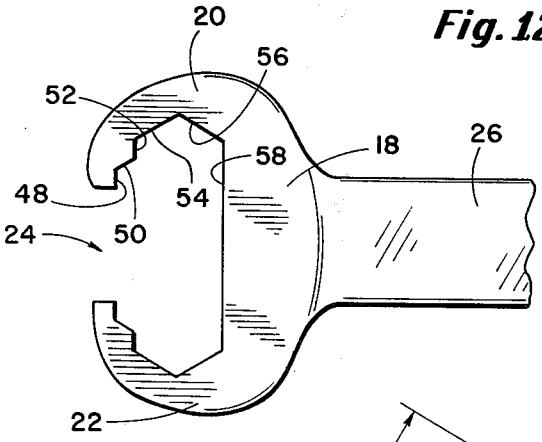

FIG. 9 is an alternate arrangement wherein the wrench is configured to ratchet rotate two different size hexagonal members in either direction without removing the wrench from the hexagonal members being rotated.

Figure 10:
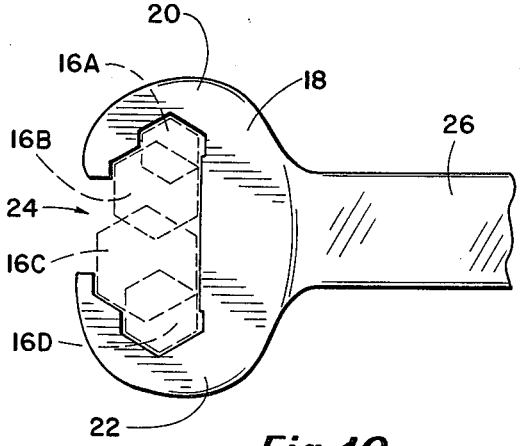

FIG. 10 shows an embodiment in which the wrench may be employed for the ratchet rotation of four different sizes of hexagonal members.

Figure 11:
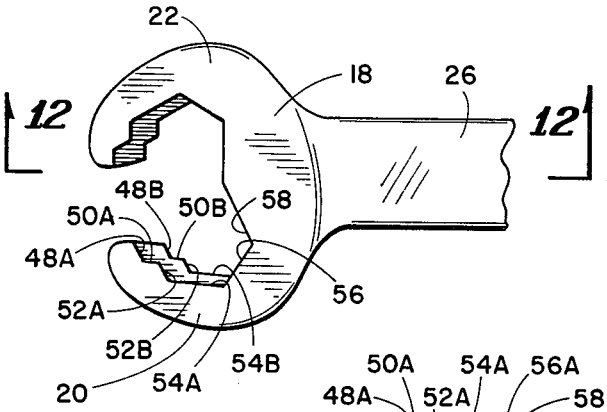

FIG. 11 shows an embodiment of the invention wherein the wrench torqueing surfaces include an upper layer and a lower layer and in which each layer of surfaces is dimensioned to engage four different size hexagonal members so that the wrench of FIG. 11 may be employed to ratchet rotate eight different sizes of hexagonal members.

Figure 12:
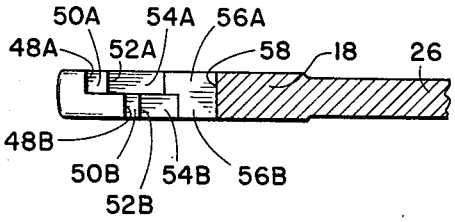

FIG. 12 is a cross sectional view taken along the line 12—12 of FIG. 11.

Figure 13:
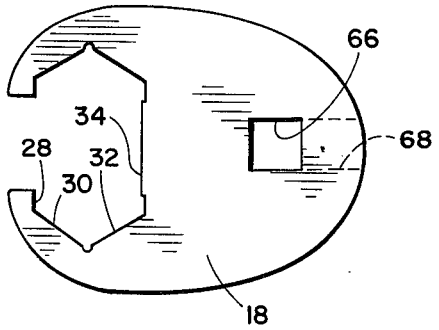

FIG. 13 shows an embodiment wherein the wrench may be encompassed in a tool generally termed a "crow foot" design in which the handle for the rotation of the tool is removable.

Figure 14:
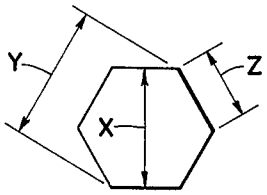

FIG. 14 is a plan view of a hexagonal member showing representative dimensions of the member.

DETAILED DESCRIPTION

Referring first to FIG. 14, a representative hexagonal member is shown. The hexagonal member has a distance between opposed sides of X, a distance between opposite corners of Y, and length along one side of Z.

FIG. 1 shows a simple embodiment of the invention. The wrench includes a body portion 18 having an integral first jaw 20 and second jaw 22. The jaws 20 and 22 are spaced apart from each other and provide a member receiving area 24 therebetween. A handle portion 26 extends from the body by which the wrench is rotated.

The first jaw 20 has an inner peripheral surface facing the member receiving area 24 having four contiguous torqueing surfaces configured to receive a hexagonal member. Each of the four torqueing surfaces are at an angle of 120° relative to any adjacent torqueing surface. The first torqueing surface 28 is at the outer end of the first jaw and has a length less than one-half Z, that is, less that one-half of the length along a side of the hexagonal member to which the wrench is dimensioned. The second torqueing surface 30 is contiguous to the first and at a length substantially equal to and just slightly greater than Z. The third torqueing surface 32 is contiguous to the second surface 30 at the end thereof opposite the first surface 28, the length of the third torqueing surface 32 being substantially equal to and just slightly greater than Z. The fourth torqueing surface 34 is contiguous to the third surface 32 at the end thererof opposite the second surface 30, the length of the fourth torqueing surface 34 being greater than Z, the fourth torqueing surface 34 being parallel to the first torqueing surface 28 and spaced from it a distance substantially equal to and just slightly greater than X.

The inner peripheral surface of the first jaw 20 made up of torqueing surfaces 28, 30, 32 and 34 is dimensioned to snugly receive a portion of the external periphery of a hexagonal member, such as bolts or nuts. The outline of a hexagonal member 16A is shown positioned against the torqueing surfaces of jaw 20 and when the wrench is rotated in the clockwise direction indicated by the rightmost arrow the hexagonal member 16A is rotated in the clockwise direction indicated by the arrow 16 therein. When the wrench is rotated in the opposite direction, that is, counterclockwise, the wrench slides upon the peripheral surfaces of the hexagonal member 16A until a new position is reached in which the direction of rotation can be again returned to clockwise. Thus the wrench jaw 20 ratchets on hexagonal member 16A to rotate in a clockwise direction.

The second jaw 22 has an inner peripheral surface facing the member receiving area 24 configured to receive four surfaces of a hexagonal member. The four torqueing surfaces of the second jaw 22 are: a first torqueing surface 36 having a length less than one-half Z; a second torqueing surface 38 having a length substantially equal to and just slightly greater than Z; a third torqueing surface 40 having a length substantially equal to and just slightly greater than Z; and a fourth torqueing surface 42 having a length greater than Z. The torqueing surfaces 36, 38, 40 and 42 are all at an angle of 120° relative to any adjacent torqueing surface. The fourth torqueing surface 42 is parallel and spaced from the first torqueing surface 36 at a distance substantially equal to and slightly greater than X.

A hexagonal member 16B is shown in dotted outline positioned in engagement with the torqueing surfaces of second jaw 22. When the wrench handle is rotated in the counterclockwise direction as indicated by the left arrow, the torqueing surfaces engage the hexagonal member 16B and rotate it in the counterclockwise direction indicated by the arrow 16C therein. When the wrench handle is moved in the clockwise direction the wrench surface slides upon the peripheral surfaces of the hexagonal member 16B until a position is reached wherein upon rotation of the wrench in the opposite direction, that is, the counterclockwise direction, the surfaces engage the hexagonal peripheral surfaces of the member 16B and cause it to rotate in the counterclockwise direction. Thus by reciprocation of the wrench with jaw 22 in engagement with the member 16B it is ratchet rotated in the counterclockwise direction.

It can thus be seen that the wrench of FIG. 1 may be used to ratchet rotate a hexagonal member in either direction without removing contact of the wrench from the member, that is, the member does not leave the member receiving area 24.

Figure 2:
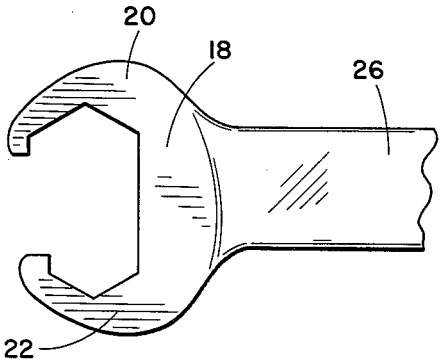
FIG. 2 is a plan view of the wrench shown in FIG. 1 but showing the wrench dimensioned for the ratchet rotation of two different size hexagonal members.

FIG. 2 shows an alternate arrangement of the invention having the same surfaces as FIG. 1 except that in FIG. 2 the surfaces of jaw 20 are dimensioned to receive and ratchet rotate a hexagonal member larger than the surfaces of jaw 22. Thus the arrangement of FIG. 2 will not be utilized for rotating the same hexagonal member in opposite directions, but the arrangement of FIG. 2 enables the wrench to be employed to rotate two different sizes of hexagonal members. In using the wrench of the arrangement of FIG. 2, the requirement for reversing the direction of rotation of a hexagonal member is that the wrench be turned over.

Figure 3:
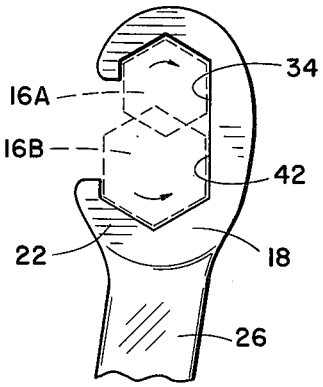
FIG. 3 shows a wrench for the ratchet rotation of two different size hexagonal members as in FIG. 2, but showing a different orientation of the handle portion.

FIG. 3 shows a wrench of the embodiment as shown in FIG. 2 but wherein the relationship of the torqueing surfaces to the longitudinal axis of the handle is different. In the arrangement of FIG. 1 the plane of the fourth torqueing surfaces for each jaw is perpendicular the longitudinal axis of handle 26 whereas in FIG. 3 the plane of the fourth torqueing surfaces in substantially parallel to the longitudinal axis of handle 26. Obviously the relationship of the surfaces relative to the handle may vary between these extremes or even beyond the extreme of FIG. 3.

Figure 4:
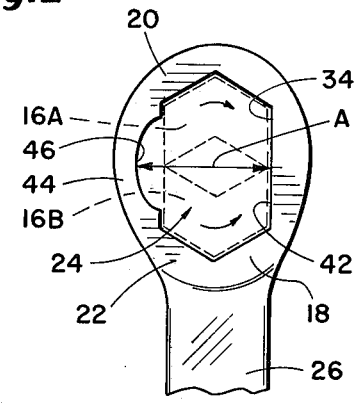
FIG. 4 shows a wrench of the box end configuration, that is, wherein the enclosure which receives the hexagonal member to be rotated fully encompasses the hexagonal member wherein the hexagonal member may be rotated in either direction without removing the wrench from engagement with the hexagonal member.

FIG. 4 shows an additional alternate arrangement in which the member receiving area 24 is completely encompassed by the wrench. The outer ends of the first and second jaws 20 and 22 are connected by an integral portion 44 which has an inner arcuate surface 46 facing the member receiving area 24. The distance indicated by A between the arcuate surface 46 and the opposed fourth torqueing surfaces 34 and 42 is greater than Y, that is, greater than the distance between opposing corners of a hexagonal member. Hexagonal members 16A and 16B are shown positioned within the member receiving area 24 to show how a hexagonal member may be rotated in opposite directions without removing the wrench from the member.

In FIGS. 1, 2, 3 and 4, the fourth torqueing surfaces 34 and 42 of each of the jaws 20 and 22 is coplanar, that is, in the same plane. FIG. 5 shows an embodiment of the invention in which the fourth torqueing surfaces 34 and 42 intersect each other at an angle greater than 180°. The wrench of FIG. 5 is shown with a wrench portion at each end in which each of the wrench portions is configured to engage separate size hexagonal members. Thus the wrench of FIG. 5 is designed to engage and ratchet rotate four different sizes of hexagonal members.

FIGS. 6 and 7 show another alternate arrangement. In this embodiment the torqueing surfaces are divided into an upper layer and a lower layer. The torqueing surfaces of the upper layer of jaw 20 are 28A and 30A, 32A and 34. The torqueing surfaces of the lower layer are 28B, 30B, 32B and 34. The upper and lower sets of torqueing surfaces are configured in the same arrangement except for dimensions and in the illustrated arrangement the upper set of torqueing surfaces 28A, 30A, 32A and 34 ratchet rotate a hexagonal member of larger dimensions than the lower torqueing surfaces 28B, 30B, 32B and 34. The fourth torqueing surface 34 serves both the upper and lower sets of torqueing surfaces. The second jaw 22 is shown also with upper and lower sets of torqueing surfaces to receive two different sizes of hexagonal members. Thus the wrench of FIG. 6 will ratchet rotate four different sizes of hexagonal members. If the wrench is provided with a similar arrangement on the opposite end of handle 26 it can be seen that the wrench using the arrangement of FIGS. 6 and 7 may be designed to ratchet rotate eight different sizes of hexagonal members.

FIG. 9 shows till an additional alternate embodiment in which each of the jaws 20 and 22 include six torqueing surfaces. Thus as in FIG. 9 jaw 20 is configured to engage a larger and a smaller hexagonal member. The torqueing surfaces of jaw 20 in FIG. 9 are as follows: first torqueing surface 48 having a length less than one-half the length along a side of the larger hexagonal member to which the wrench is sized, second torqueing surfaces 50, a third torqueing surface 52 having a length less than one-half the length along a side of the smaller hexagonal member, a fourth torqueing surface 54, a fifth torqueing surface 56 and a sixth torqueing surface 58. Each of the surfaces are 120° relative to adjacent surfaces. The first surface 48 and third surface 52 are each parallel to the sixth torqueing surface 58. The spacing between the sixth torqueing surface 58 and torqueing surface 52 is substantially equal to and just slightly greater than the width X of the smaller hexagonal member to be received by the wrench and the first torqueing surface 48 parallel to and spaced from the sixth torqueing surface 58 is substantially equal to and just slightly greater than the width of the larger of the hexagonal members to be received by jaw 20.

Jaw 22 has torqueing surfaces complimentary to those of jaw 20. The larger of the hexagonal members to be ratchet rotated is engaged by surfaces 48, 50 and 58, and the smaller hexagonal member to be ratchet rotated by the wrench of FIG. 9 is engaged by surfaces 52, 54, 56 and 58. In the arrangement of FIG. 9 it can be seen that two different size hexagonal members may be ratchet rotated in either direction without removing the wrench from engagement with the hexagonal member being rotated.

FIG. 10 shows the embodiment as in FIG. 9 but wherein jaw 20 is dimensioned to engage two different size members and jaw 22 is configured to engage two other different size members so that the wrench of FIG. 10 may be employed to ratchet rotate four different size members. It can be seen, however, that in the arrangement of FIG. 10 the wrench cannot be used to rotate the members in the opposite direction without turning the wrench over.

FIG. 8 shows a wrench design with some alternate arrangements. In the right end of FIG. 8 the wrench jaw 20 includes in the outer end thereof a small hard metallic insert 60 such as tungsten carbide, which forms a part of the first torqueing surface 28. This increases the wear life of the wrench. In addition, if desired, the metallic inserts 60 may have an inner end sharpened in a tooth arrangement which protrudes slightly beyond the surface 28 so as to engage and grip into a hexagonal member. The jaw 22 also shows a hard metal insert 60.

In the left hand side of FIG. 8, each of the four torqueing surfaces 34 and 42 are provided with recesses 62 therein adjacent the corresponding third torqueing surfaces 32 and 40 respectively. The recesses 62 help the wrench torqueing surfaces to slide into position easily relative to a hexagonal member to be gripped. In addition, the recesses 62 are in areas which do not impart torque to a member being rotated so that the torque imparting ability of the wrench is not diminished.

FIG. 8 at the left hand side shows smaller semicircular cutout 64 at the intersection of first torqueing surfaces 30 and 32 of first jaw 20 and correspondingly at the intersection of second surface 38 and third surface 40 of jaw 22. The semicircular recess allows the hexagonal member to firmly engage the torqueing surfaces and compensates for defects in the symmetry of the hexagonal surfaces of members to be rotated.

FIG. 11 shows an additional alternate arrangement of the invention, including concepts embodied in portions of previously described embodiments represented by FIGS. 6 and 9. FIG. 11 shows the arrangement wherein both jaw 20 and jaw 22 include six torqueing surfaces in both an upper and lower level. For instance, as to jaw 22 the six upper torqueing surfaces are 48A, 50A, 52A, 54A, 56A and 58A. The lower torqueing surfaces of jaw 22 are 48B, 50B, 52B, 54B, 56B and 58B. Thus the jaw 22 is configured to engage two different size hexagonal members on the lower layer of surfaces. If jaws 20 and 22 are each configured to engage different size hexagonal members it can be seen that in the arrangement of FIGS. 11 and 12 the wrench at one end may engage eight different sizes of hexagonal members. By combining the wrench with a similar arrangement at the opposite end one wrench without moving parts may be employed to ratchet rotate 16 different sizes of hexagonal members.

FIG. 13 shows the arrangement of the invention in the form of a type commonly called a crow foot. The wrench body does not have a handle but includes a recess 66 which may receive a handle, or the handle may be inserted longitudinally into recess 68.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is limited only by the scope of the attached claim or claims, including the full range of equivalency to which each element or step thereof is entitled.

What is claimed is:

1. A ratcheting wrench for ratcheting four hexagonal members in which the distance between opposite sides is $X_1$, $X_2$, $X_3$ and $X_4$ and the length along a side is $Z_1$, $Z_2$, $Z_3$ and $Z_4$, respectively, the wrench comprising:

a body portion having a first jaw and a second jaw extending therefrom, the jaws being spaced apart from each other and providing a member receiving area therebetween, and a handle extending from said body;

the first jaw having an inner peripheral surface facing said member receiving area having six torqueing surfaces configured to engage a portion of the peripheral surface of the first and second hexagonal member, the first hexagonal member being larger than the second, the first surface being at the outer end of said first jaw and having a length less than one-half $Z_1$ the second surface intersecting the first surface at an angle of 120°, the third surface being contiguous to the second surface at the end thereof opposite the end intersected by the first surface, the length of the third surface being less than one-half $Z_2$, a fourth surface intersecting the third surface at an angle of 120°, a fifth surface intersecting the fourth surface at an angle of 120°, the length of the fourth and fifth surfaces each being at least equal to $Z_2$, and a sixth surface intersecting the fifth surface at an angle of 120°, the length of the sixth surface being greater than $Z_1$, the first surface being parallel to the sixth surface and spaced from it a distance at least equal to $X_1$ the third surface being parallel to the sixth surface and spaced from it a distance at least equal to $X_2$, the first, second and sixth surfaces snugly receiving and engaging three sides of the first hexagonal member, the third, fourth, fifth and sixth surfaces snugly receiving and engaging four sides of the second hexagonal member;

the second jaw having an inner peripheral surface facing said member receiving area having six torqueing surfaces configured to engage a portion of the peripheral surfaces of the third and fourth hexagonal member, the third hexagonal member being larger than the fourth, the first surface being at the outer end of said second surface intersecting the first surface at an angle of 120°, the third surface intersecting the second surface at an angle of 240° at the end thereof opposite the end intersected by the first surface, the length less than one-half $Z_4$, a fourth surface intersecting the third surface at an angle of 120°, a fifth surface intersecting the fourth surface at an angle of 120°, the length of the fourth and fifth surfaces each being at least equal to $Z_4$, and a sixth surface intersecting the fifth at an angle of 120°, the length of the sixth surface being greater than $Z_3$, the first surface being parallel to the sixth surface and spaced from it a distance at least equal to $X_3$, the third surface being parallel to the sixth surface and spaced from it a distance at least equal to $X_4$, the first, second and sixth surfaces snugly receiving and engaging three sides of the third hexagonal member, the third, fourth, fifth and sixth surfaces snugly receiving and engaging four sides of the fourth hexagonal member.

2. A ratcheting wrench according to claim 1 wherein the first and third hexagonal members are the same size and the second and fourth hexagonal members are the same size, and wherein the torqueing surfaces of said first jaw are dimensioned the same as the torqueing surfaces of said second jaw, wherein two different sized hexagonal members may be ratchet rotated in one direction by engagement with the torqueing surfaces of said first jaw and ratchet rotated in the opposite direction by engagement with the torqueing surfaces of said jaw.

3. A ratcheting wrench according to claim 1 wherein said first jaw sixth surface is coplanar with said second jaw sixth surface.

4. A ratcheting wrench according to claim 1 wherein said first jaw sixth surface intersects said second jaw sixth surface at an angle.

5. A ratcheting wrench according to claim 1 wherein said sixth surface of each of said jaws has a recess area therein adjacent the intersecting fifth surface, the space between said recess area and said opposing first and third surfaces being thereby slightly increased, facilitating the positioning of hexagonal members into contact with the torqueing surfaces.

6. A ratcheting wrench according to claim 1 wherein said torqueing surfaces of said first and second jaws are each divided into an upper level and a lower level, each level of each jaw having a set of torqueing surfaces of said first jaw upper level dimensioned to engage two different sizes of hexagonal members, the set of torqueing surfaces of said second jaw upper portion dimensioned to engage two different hexagonal members, the wrench being thereby dimensioned to ratchet rotate eight different size hexagonal members.

7. A ratcheting wrench according to claim 6 wherein the four sets of ratcheting surfaces of said first jaw are dimensioned the same as said four sets of ratcheting surfaces of said second jaw whereby the wrench may be used to ratchet rotate four different dimensioned hexagonal members in opposite directions.

* * * * *